US007249899B2

(12) United States Patent
Kishi et al.

(10) Patent No.: US 7,249,899 B2
(45) Date of Patent: Jul. 31, 2007

(54) TAPE PRINTING APPARATUS AND TAPE PRINTING SYSTEM

(75) Inventors: Motoshi Kishi, Nagoya (JP); Satoru Moriyama, Iwakura (JP); Tomoki Miyashita, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 258 days.

(21) Appl. No.: 10/900,276

(22) Filed: Jul. 28, 2004

(65) Prior Publication Data

US 2005/0031393 A1 Feb. 10, 2005

(30) Foreign Application Priority Data

Aug. 7, 2003 (JP) ..... 2003-288892

(51) Int. Cl.
*B41J 11/44* (2006.01)

(52) U.S. Cl. ..... 400/76; 400/62; 400/586

(58) Field of Classification Search ..... 400/61, 400/62, 70, 76, 568, 611, 658
See application file for complete search history.

(56) References Cited

U.S. PATENT DOCUMENTS

| | | | | |
|---|---|---|---|---|
| 4,665,407 | A * | 5/1987 | Hattori et al. | 347/197 |
| 5,139,351 | A | 8/1992 | Kamada | |
| 5,294,203 | A * | 3/1994 | Williams | 400/234 |
| 5,536,092 | A | 7/1996 | Yamaguchi | |
| 5,636,926 | A | 6/1997 | Yamaguchi | |
| 5,681,123 | A | 10/1997 | Yamaguchi | |
| 5,730,536 | A | 3/1998 | Yamaguchi | |
| 5,980,142 | A | 11/1999 | Inui | |

FOREIGN PATENT DOCUMENTS

| | | |
|---|---|---|
| EP | 0 841 180 A | 5/1998 |
| JP | 59-045180 A | 3/1984 |
| JP | U-60-88748 | 6/1985 |
| JP | A-4-67976 | 3/1992 |
| JP | A-5-262019 | 10/1993 |
| JP | A-7-68814 | 3/1995 |
| JP | A 7-101117 | 4/1995 |
| JP | A-2001-77988 | 3/2001 |
| JP | A-2002-014799 | 1/2002 |
| JP | A-2003-076679 | 3/2003 |

* cited by examiner

*Primary Examiner*—Minh Chau
(74) *Attorney, Agent, or Firm*—Oliff & Berridge, PLC

(57) ABSTRACT

A tape printing apparatus and the tape printing system capable of preventing deformation of the rollers or sticking thereof to a print head, and capable of preventing degradations in tape feeding accuracy and the inability to print. The tape printing apparatus has a platen roller and a tape feeding roller movable between a pressing position at which they are pressed against a tape accumulated in a cassette and a releasing position in which they are remote from the tape and arranged to perform printing by performing tape feeding upon disposing the platen roller and the tape feeding roller at the pressing position. The apparatus includes a roller driving portion that moves the platen roller and the tape feeding roller between the pressing position and the releasing position and a controller that controls the roller driving portion in correspondence with input signals.

35 Claims, 13 Drawing Sheets

TAPE PRINTING APPARATUS AND TAPE PRINTING SYSTEM

This application claims priority from JP 2003-288892, filed Aug. 7, 2003, the entirety of which is incorporated herein by reference thereto.

BACKGROUND OF THE INVENTION

1. Field of Invention

The invention relates to a tape printing apparatus for printing letters onto a tape. The invention also relates to a tape printing system in which the tape printing apparatus is connected to an input device whereupon letters or symbols that have been input through the input device are printed onto a tape.

2. Description of Related Art

Japanese Patent Laid-Open Publication No. 7-101117 (1995) (Pages 2 to 5, FIG. 5) discloses a tape printing apparatus. This tape printing apparatus is arranged in that a cassette, accommodating therein a tape that is overlapped onto an ink ribbon, is mounted thereto. The printing apparatus comprises a tape feeding roller and a platen roller that are pressed against the tape. A print head with a plurality of aligned heater elements is provided at a position facing the platen roller.

When performing printing, the tape feeding roller is pressed against a tape driving roller, which is disposed within the cassette, with the tape between. The platen roller is pressed against the print head, which is inserted into the cassette, with the tape between. Feeding of the tape is performed through rotation of the tape feeding roller and the platen roller while letters or symbols, and the like, are printed onto the tape by fusing the ink ribbon through the print head.

The tape feeding roller and the platen roller are arranged to be movable in engagement with an opening/closing cover that opens and closes at the time of insertion/ejection of the cassette. When the opening/closing cover is closed upon mounting the cassette, the tape feeding roller and the platen roller are disposed at a pressing position to press against the tape through engagement with the opening/closing cover. When ejecting the cassette, the tape feeding roller and the platen roller are released from engagement with the opening/closing cover and are disposed at a releasing position at which they are remote from the tape through the biasing force of a biasing spring. With this structure, pressing at the time of printing, and releasing at the time of ejecting the cassette, can be easily performed.

SUMMARY OF THE INVENTION

According to the above conventional tape printing apparatus, the tape feeding roller and the platen roller are disposed at the pressing position for extended periods due to the opening/closing cover remaining closed when the tape printing apparatus is not in use. As a result of this configuration, the platen roller is deformed through contact with the print head resulting in degraded tape feeding accuracy. Also, when the cassette is mounted in the apparatus, the tape feeding roller is similarly deformed through contact with the tape driving roller so that the tape feeding accuracy is further degraded. When the cassette is not mounted in the apparatus, the platen roller and the print head stick together thereby deteriorating the print head such that the deterioration might lead to an inability to print.

According to a first aspect of the invention, there is provided a tape printing apparatus comprised with rollers movable between a pressing position, at which they are pressed against a tape accommodated in a cassette, and a releasing position, at which they are remote from the tape. The rollers are arranged to perform printing by performing tape feeding through rotation of the rollers disposed at the pressing position. The device also comprises a roller driving portion that moves the rollers between the pressing position and the releasing position and a controller that controls the roller driving portion in correspondence with input signals.

According to this structure, the roller driving portion is controlled by the controller to dispose the rollers at the releasing position when, for instance, ejecting the cassette. When performing, for instance, printing, the roller driving portion is controlled by the controller to dispose the rollers at the pressing position. Control of the roller driving portion may be in response to input signals, such as signals that are input to the controller and that are sent from a personal computer to the tape printing apparatus through an interface, cover open signals that are output upon detecting an open condition of the opening/closing cover of the tape printing apparatus, signals from operating switches provided at the tape printing apparatus such as ON/OFF signals of a power switch of the tape printing apparatus or ON signals of a printing start switch, and detection signals of errors that have occurred during printing processes of the tape printing apparatus.

With this structure, it is possible to prevent deformation of the rollers and to prevent the rollers from sticking to the print head by disposing the rollers at the releasing position when the tape printing apparatus is in an idle state, and/or not in use. Accordingly, it is possible to prevent degradation in tape feeding accuracy and the inability to print.

BRIEF DESCRIPTION OF THE DRAWINGS

Hereinafter, the preferred exemplary embodiments of the invention will be described in detail with reference to the accompanying drawings.

DETAILED DESCRIPTION OF PREFERRED EMBODIMENTS

Figure 1:
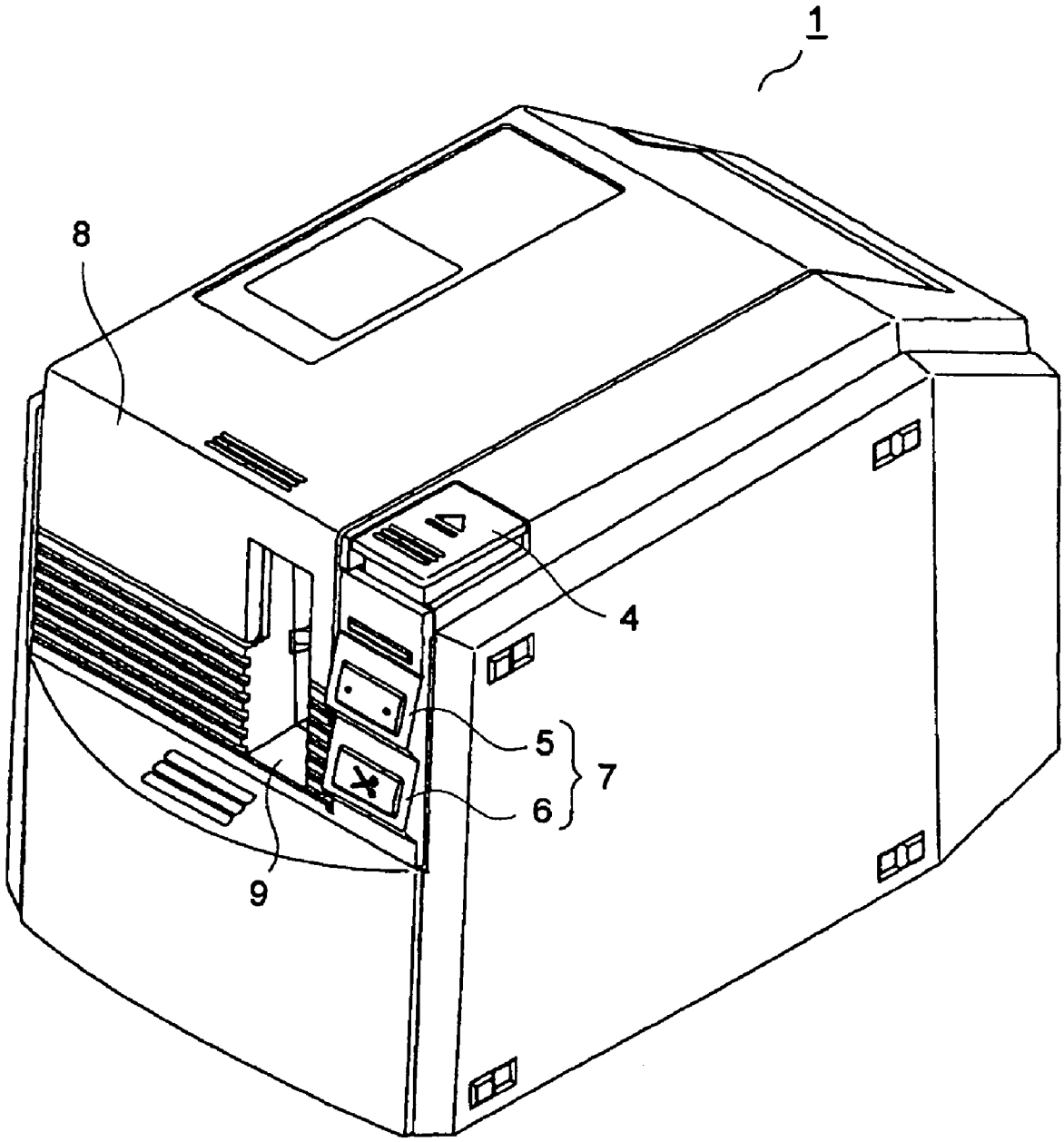
FIG. 1 is a perspective view illustrating the tape printing apparatus according to an exemplary embodiment of the invention.

Preferred exemplary embodiment of the invention will now be explained with reference to the drawings. FIG. 1 is a perspective view illustrating a tape printing apparatus according to one embodiment. An opening/closing cover 8 that is opened and closed when inserting and ejecting a cassette 20 accommodating a tape therein (see FIG. 5) is provided on a top surface of a tape printing apparatus 1. An open switch 4 for opening the opening/closing cover 8 is disposed at a side portion of the opening/closing cover 8.

An aperture 9 from which the tape is discharged is provided at a front surface of the tape printing apparatus 1. An operating portion 7 including a power switch 5 and a cutting switch 6 is disposed at a side portion of the aperture 9. The power switch 5 performs ON/OFF operations of power for an apparatus main body of the tape printing apparatus 1. The cutting switch 6 is pushed when manually cutting the tape that is discharged from the aperture 9.

Figure 2:
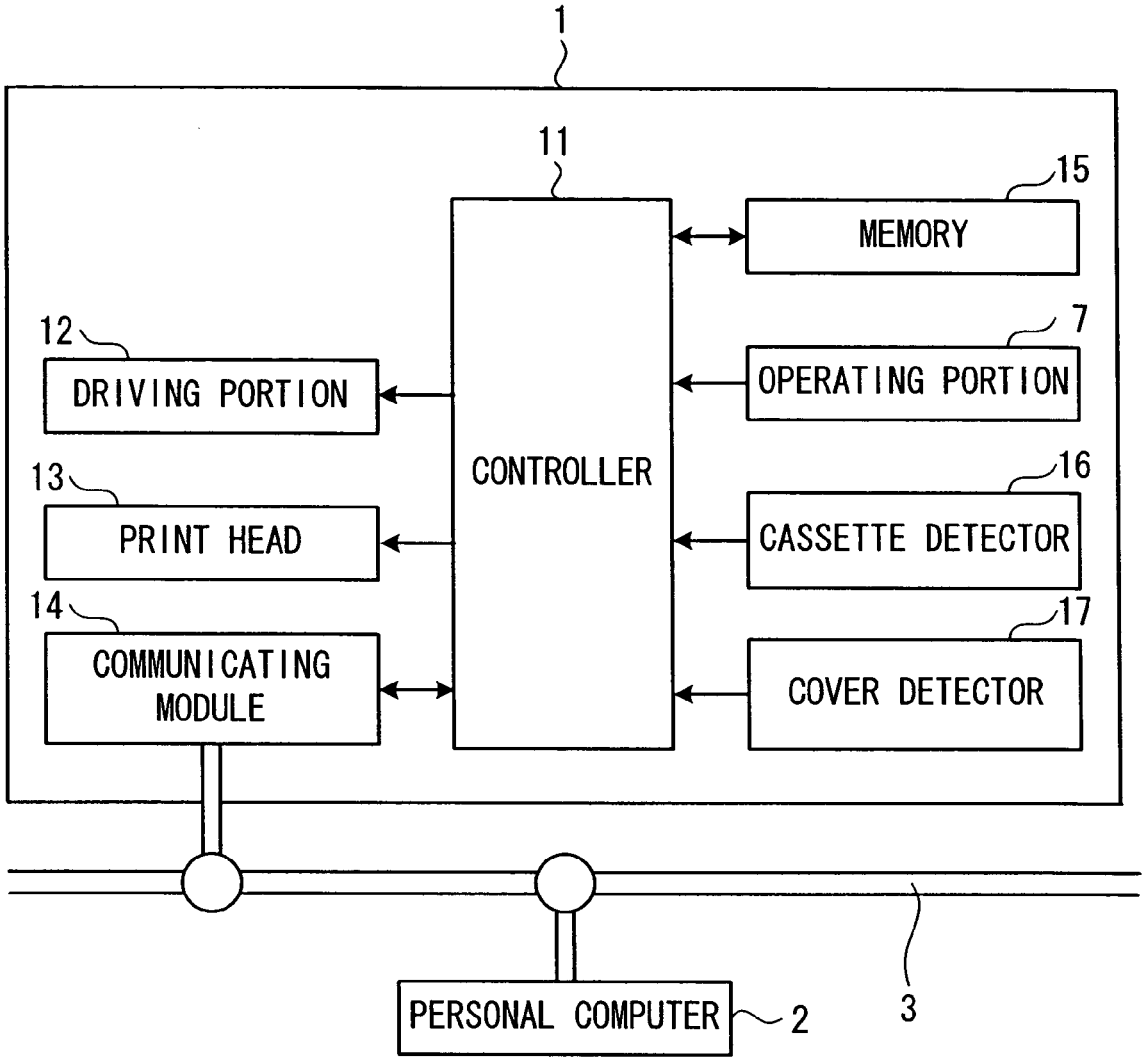
FIG. 2 is a block diagram illustrating a tape printing system provided with the tape printing apparatus according to an exemplary embodiment of the invention.

FIG. 2 is a block diagram illustrating a structure of the tape printing apparatus 1. The tape printing apparatus 1 is connected to a personal computer 2 (input device) via a network 3. An editor for inputting print data is installed in the personal computer 2, and printing is performed through the tape printing apparatus 1 upon instructions of the editor. It is also possible to employ a local connection in which the tape printing apparatus 1 and the personal computer 2 are directly connected without passing via the network 3.

The tape printing apparatus 1 includes a controller 11 that controls respective portions of the apparatus 1. A driving portion 12, a print head 13, a communicating module 14, a memory 15, an operating portion 7, a cassette detector 16, and a cover detector 17 are connected to the controller 11. The driving portion 12 includes one or more motors and performs moving of tape feeding rollers 39, 40 (see FIG. 3) and driving of a cutter 52 (see FIG. 3).

The print head 13 includes a plurality of heater elements aligned in a width direction of the tape. Ink from an ink ribbon is fused to the tape through the generation of heat by the heater elements. The communicating module 14 is comprised of a receiver for receiving, for instance, print data or the like and a sending portion for sending, for instance, printing results or signals concerning mounting conditions of the cassette 20.

The memory 15 is comprised of a non-volatile memory into which operating programs or setting conditions are stored, and a volatile memory including a print buffer that performs temporal storage of print data. The cassette detector 16 detects whether a cassette has been mounted. The cover detector 17 detects an open/closed condition of the opening/closing cover 8 (see FIG. 1).

Figure 3:
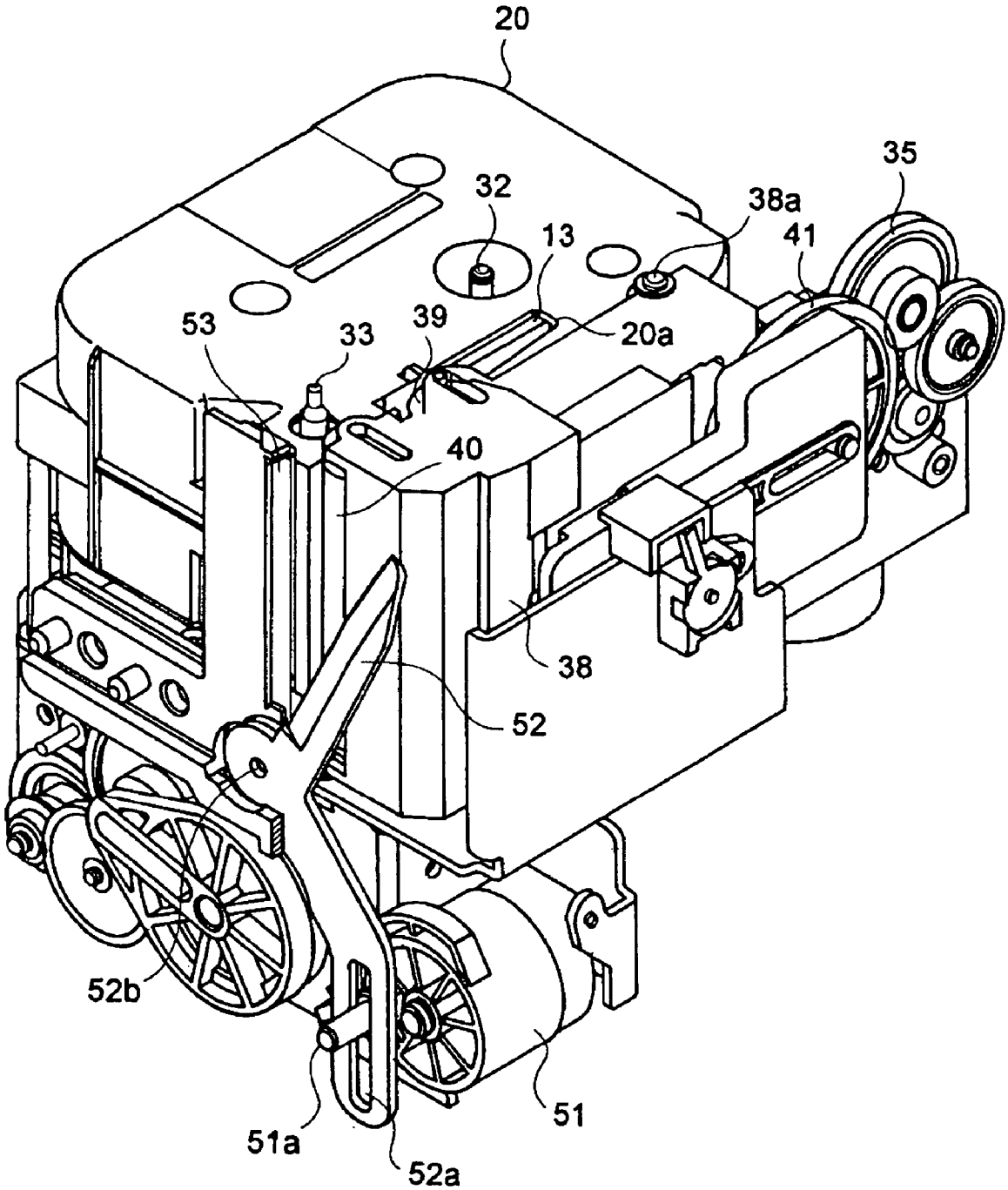
FIG. 3 is a perspective view illustrating an interior of the tape printing apparatus according to an exemplary embodiment of the invention.
Figure 4:
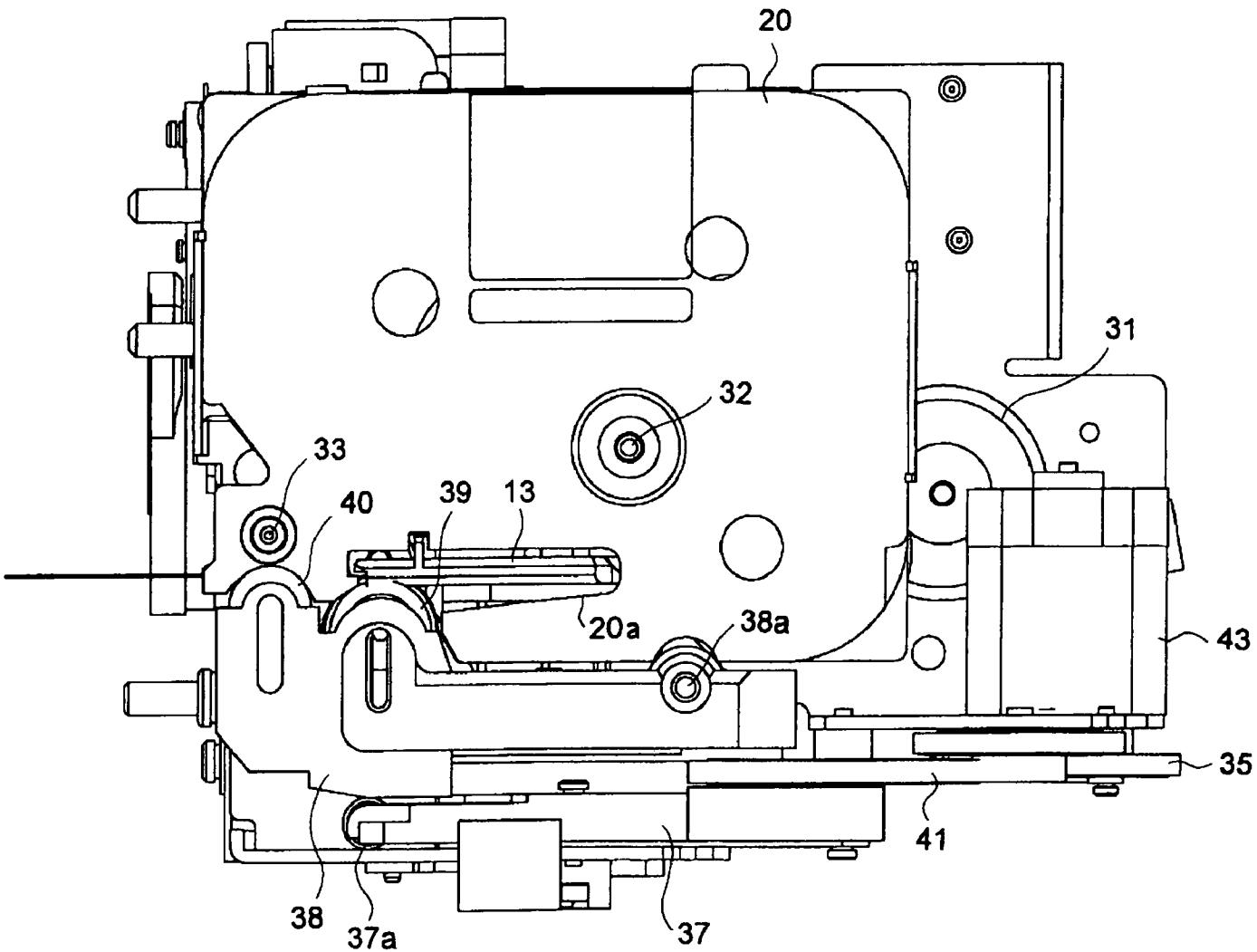
FIG. 4 is a top view illustrating an interior of the tape printing apparatus according to an exemplary embodiment of the invention.

FIGS. 3 and 4 are a perspective view and a top view, respectively, illustrating main portions of an internal structure of the tape printing apparatus 1. The cassette 20 is mounted onto a top portion of the tape printing apparatus 1. A tape feeding motor 31 is disposed downward of a backside of the cassette 20. A driving gear 32, a tape feeding gear 33, and a platen idle gear 34 (see FIG. 5) are connected to the tape feeding motor 31 so as to rotate in conjunction therewith.

Figure 5:
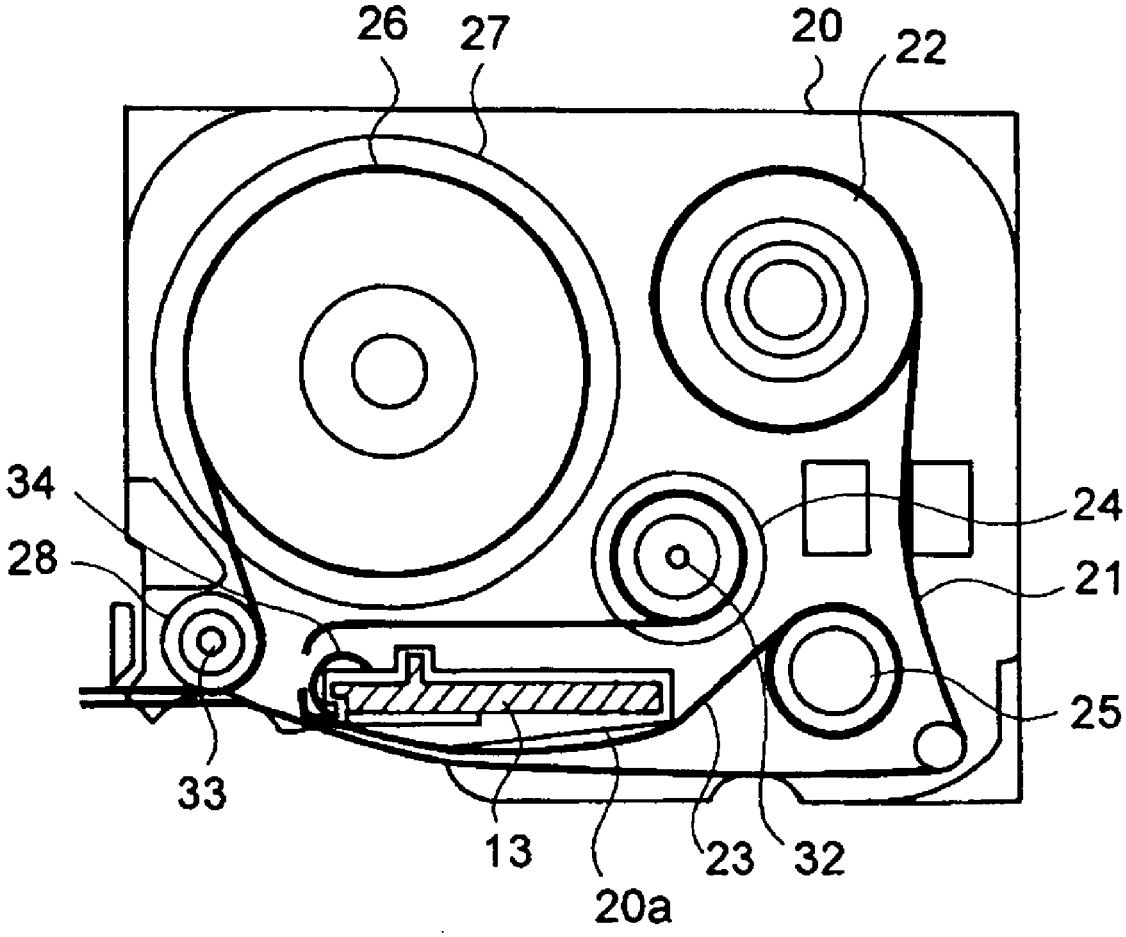
FIG. 5 is a plan view illustrating a cassette of the tape printing apparatus according to an exemplary embodiment of the invention.

FIG. 5 illustrates an internal structure of the cassette 20. The cassette 20 accommodates therein an ink ribbon 23 and an adhesive tape 26 together with a transparent tape 21 on which printing is performed. The tape 21 is wound around a reel 22. The ink ribbon 23 is wound around a reel 25 and is wound up by a reel 24 that is driven with the driving gear 32.

The adhesive tape 26 is wound around a reel 27 Both surfaces of the adhesive tape 26 are formed as adhesive surfaces. A peel-off paper is adhered to one surface of the adhesive tape 26 and the other surface is made to adhere to a printing surface of the transparent tape 21. The cassette 20 is provided with a tape driving roller 28 at an end portion on the left-hand side in the drawing. The tape driving roller 28 is driven with the tape feeding gear 33 for feeding the tape 21 and the adhesive tape 26. An aperture 20*a* into which the print head 13 is inserted is also formed in the cassette 20.

In FIGS. 3 and 4, a roller holder 38 is disposed at a side portion of the cassette 20. The roller holder 38 is rotatably supported by a shaft portion 38*a* and is biased by a biasing means (not shown) in a direction in which it separates from the cassette 20. A platen roller 39 and a tape feeding roller 40 are provided at a free end side of the roller holder 38.

The platen roller 39 coaxially includes a platen gear (not shown) that may be geared with the platen idle gear 34 so that it may be rotated by driving the tape feeding motor 31. The tape feeding roller 40 coaxially includes a sub-tape feeding gear (not shown) that may be geared with the tape feeding gear 33 so that it may be rotated by driving the tape feeding motor 31.

A release rod 37 that abuts the roller holder 38 through a release roller 37*a* is disposed at a side portion of the roller holder 38. As illustrated in the side view of FIG. 6, the release rod 37 is in engagement with a cam (not shown) of the release gear 41 that is connected to a roller driving motor 43 through a reduction gear train 35.

Figure 6:
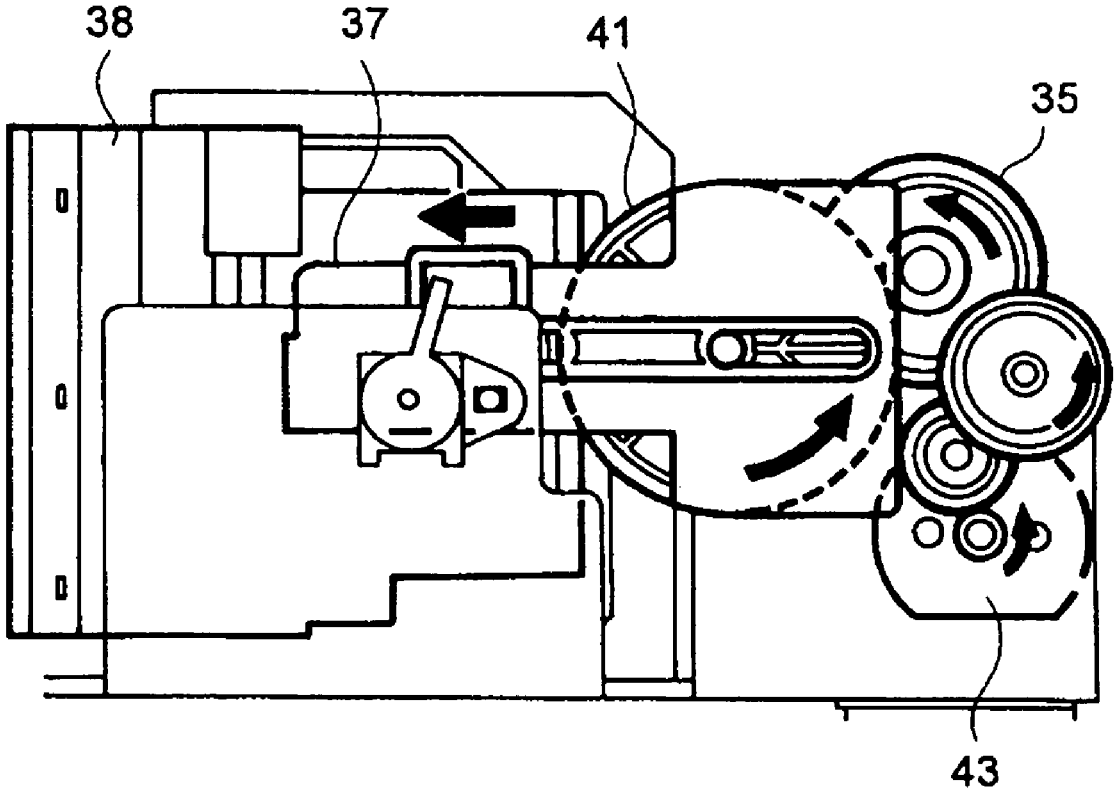
FIG. 6 is a side view illustrating an interior of the tape printing apparatus according to an exemplary embodiment of the invention.

Through the cam engagement with the release gear 41 that rotates upon driving of the roller driving motor 43, the release rod 37 is slidable in back and forth directions (right and left directions in FIG. 6). In this respect, it is also possible to connect the release gear 41 to the tape feeding motor 31 through a cam gear or similar means to thus omit the roller driving motor 43.

When the release rod 37 is slid forward, the roller holder 38 comes close to the cassette 20, as illustrated in FIGS. 3 and 4. As a result, the platen roller 39 is pressed against the print head 13 with the tape 21 and the ink ribbon 23 in-between. The tape feeding roller 40 is pressed against the tape driving roller 28 with the tape 21 and the adhesive tape 26 in-between.

The platen roller 39 and the tape feeding roller 40 are therefore disposed at a pressing position at which they press against the tape 21. In this manner, the platen roller 39 is rotated by driving of the tape feeding motor 31, and feeding of the tape 21 and the ink ribbon 23 pinched between the platen roller 39 and the print head 13 is performed. The tape driving roller 28 and the tape feeding roller 40 are rotated so that feeding of the tape 21 and the adhesive tape 26 pinched therebetween is performed.

Figure 7:
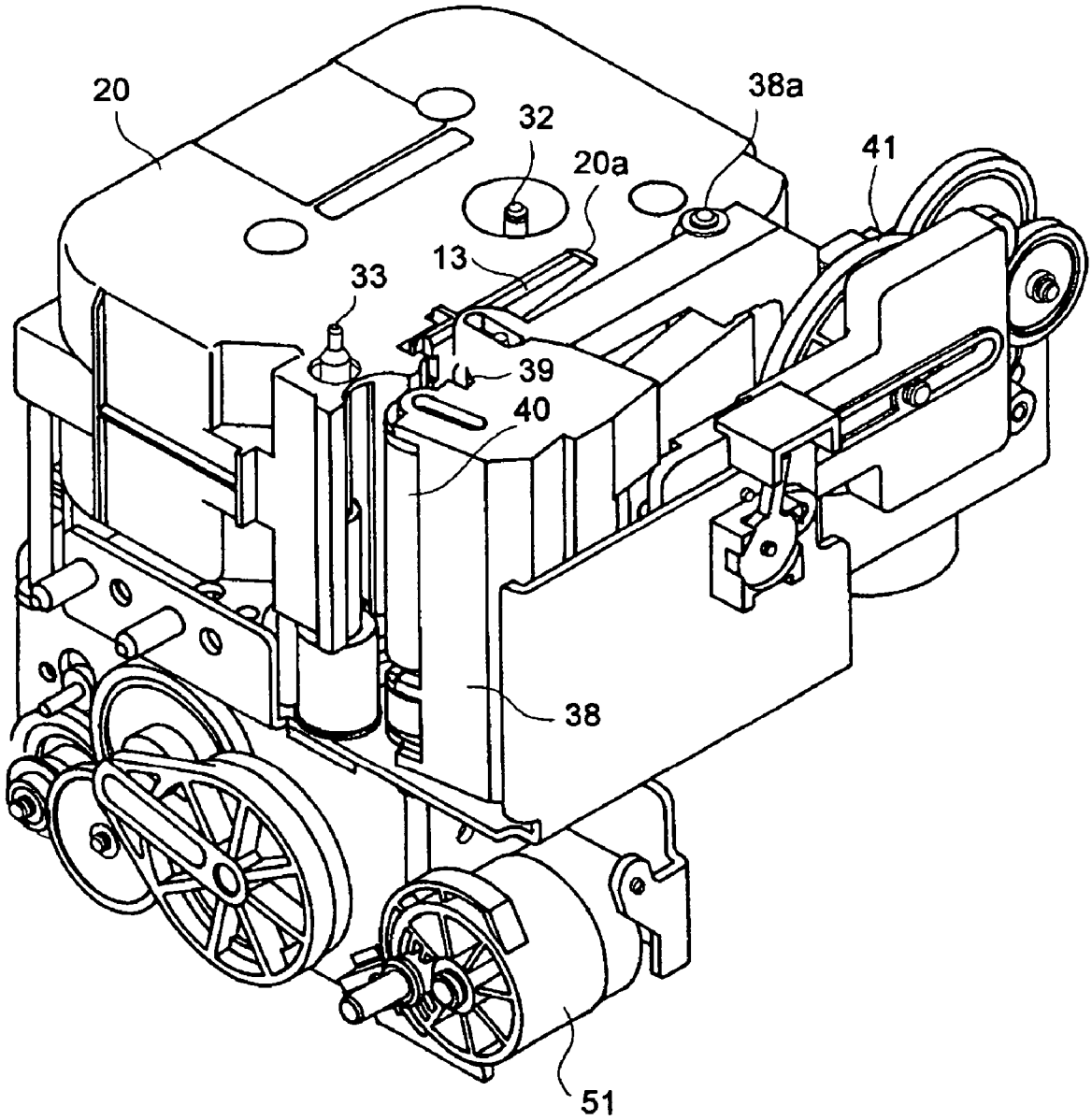
FIG. 7 is a perspective view illustrating a releasing condition of the tape printing apparatus according to an exemplary embodiment of the invention.
Figure 8:
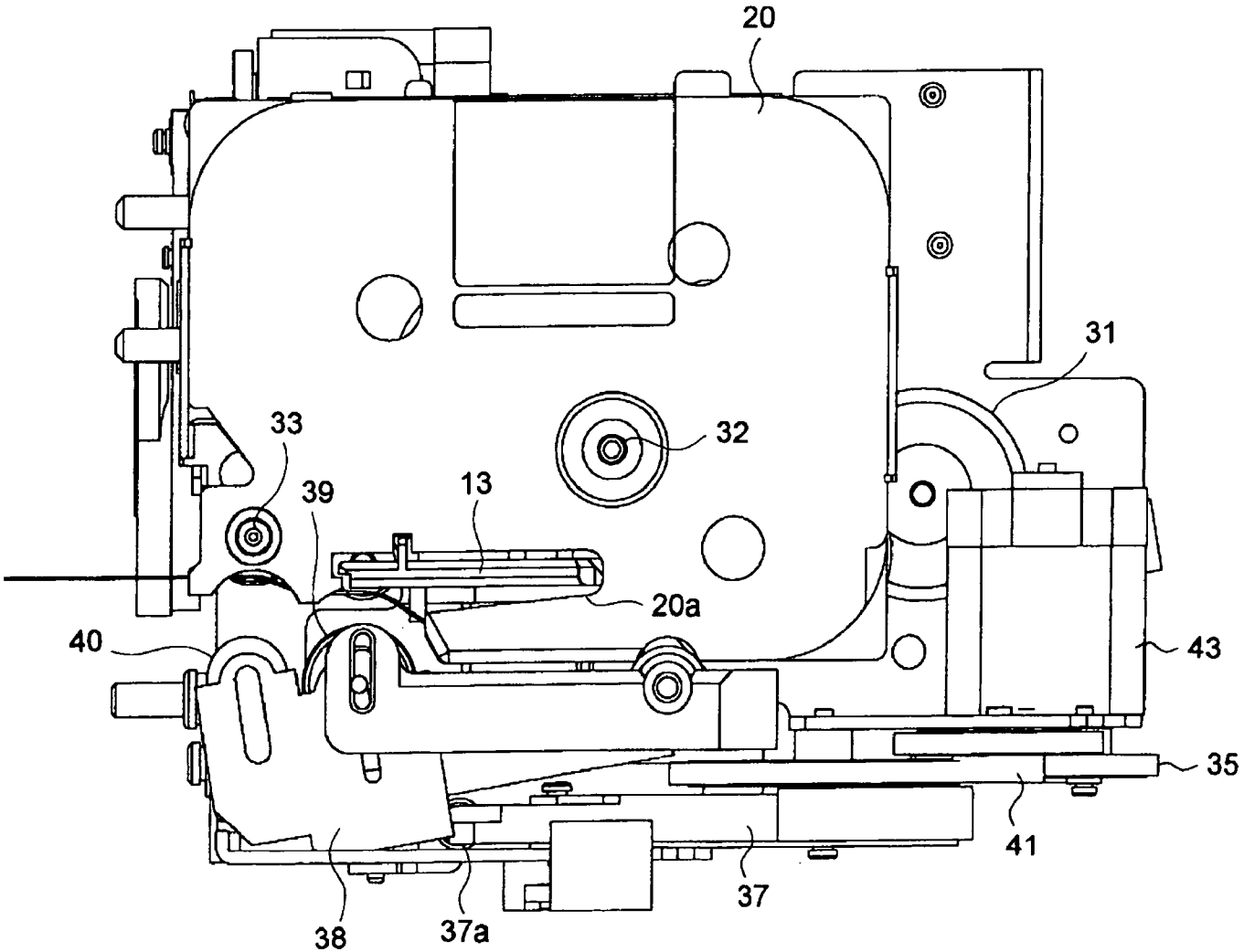
FIG. 8 is a top view illustrating a releasing condition of the tape printing apparatus according to an exemplary embodiment of the invention.

When the release rod 37 is slid rearward, the roller holder 38 separates from the cassette 20 through biasing force as illustrated in FIGS. 7 and 8. The platen roller 39 and the tape feeding roller 40 are accordingly disposed at a releasing position that is remote from the tape 21 making it possible to eject the cassette 20.

In FIG. 3, a movable cutter 52 and a stationary cutter 53 are disposed at a front portion of the tape printing apparatus 1. The movable cutter 52 is arranged in that a boss 51*a* of a cutter gear 51 that rotates upon driving of a cutter motor (not shown) is engaged with a hole portion 52*a* of the cutter 52 and in that it rotates around a shaft portion 52*b*. In this manner, it is possible to cut the tape 21 that is sent out from the cassette 20.

Figure 9:
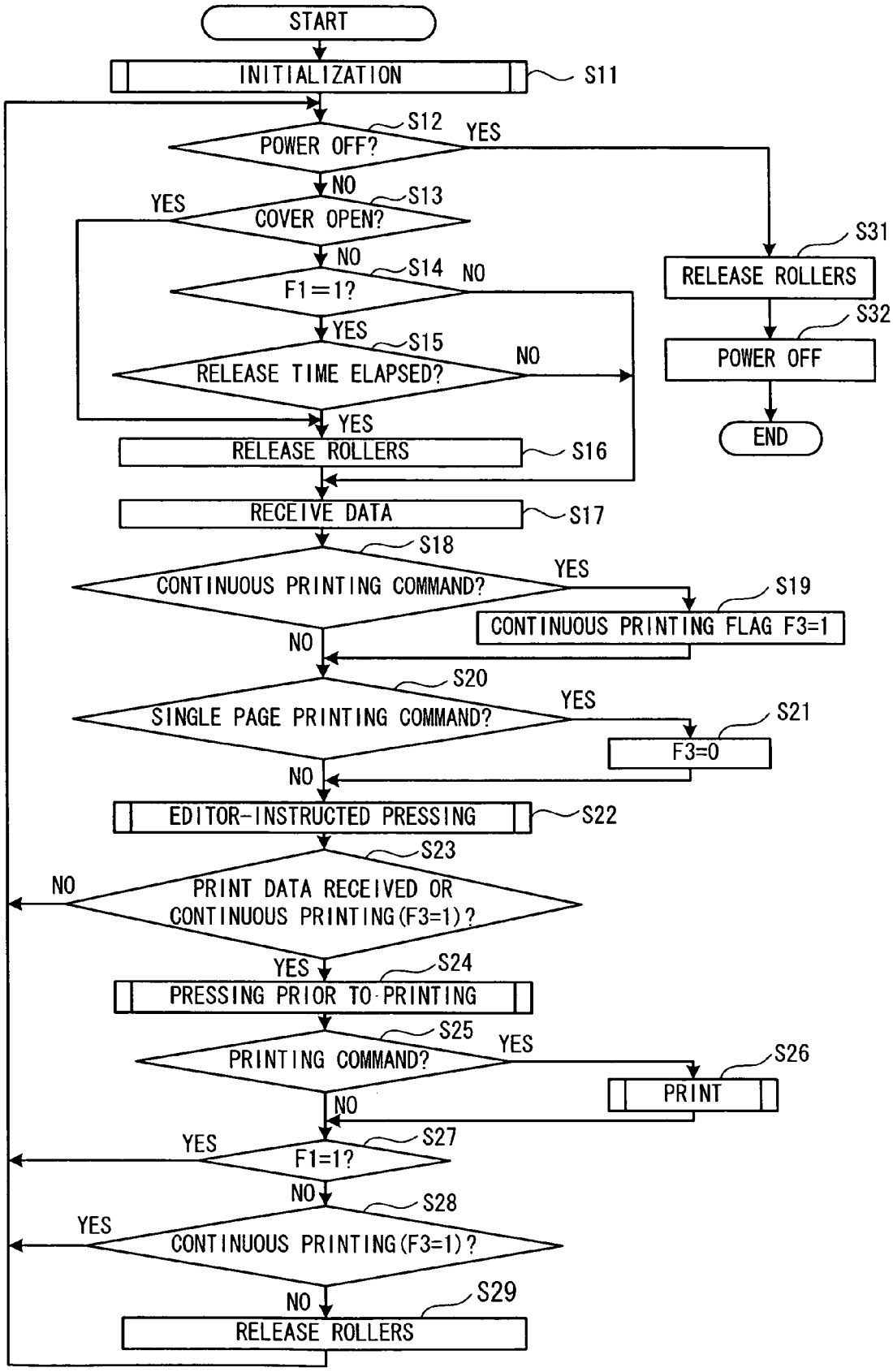
FIG. 9 is a flowchart illustrating a main program of the tape printing apparatus according to an exemplary embodiment of the invention.
Figure 10:
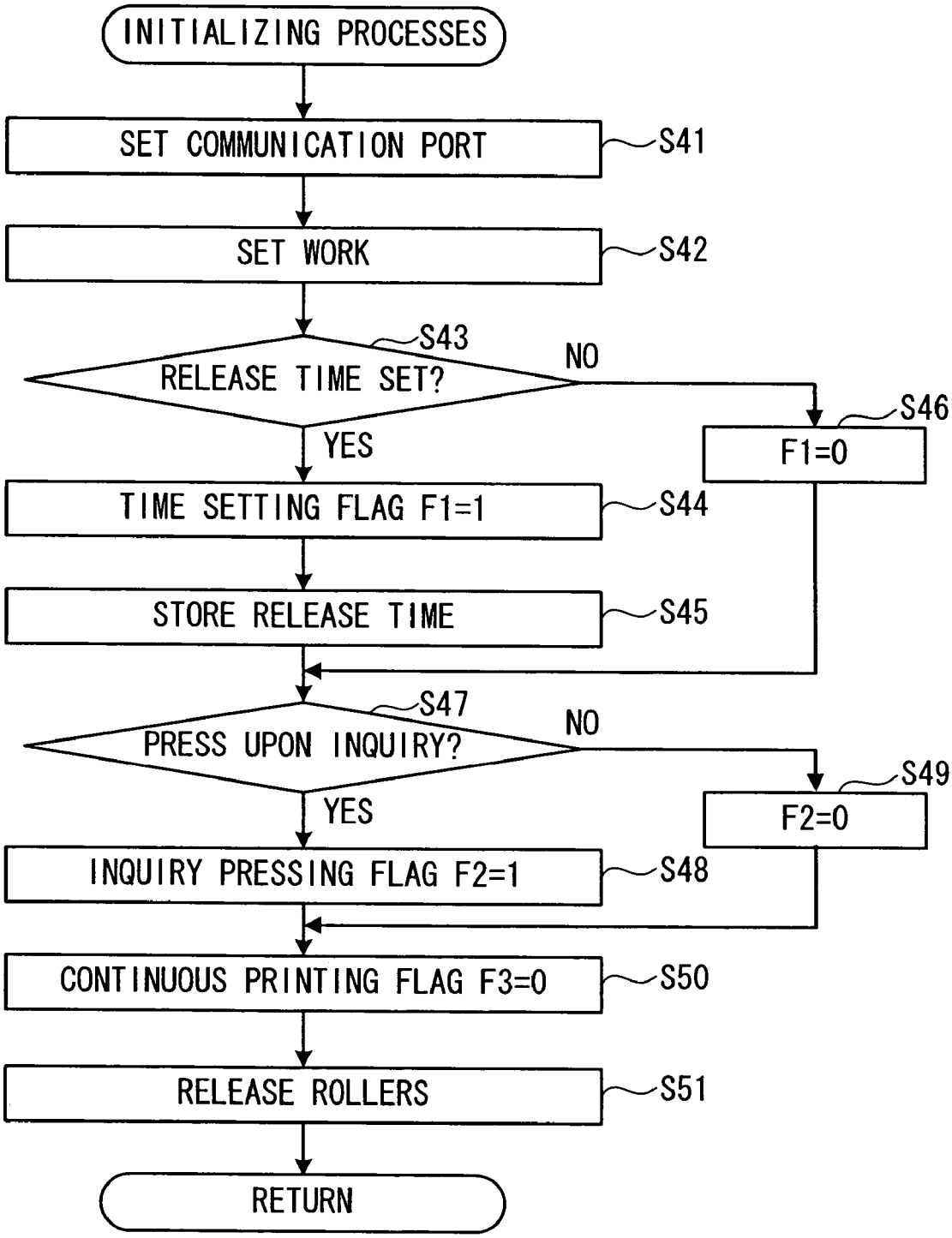
FIG. 10 is a flowchart illustrating initializing processes of the tape printing apparatus according to an exemplary embodiment of the invention.

Operation of the tape printing apparatus 1 will now be explained with reference to the flowcharts of FIGS. 9 to 13. When the power is switched ON through the power switch 5 of the tape printing apparatus 1, the main program of FIG. 9 is started. Upon start-up of the main program, initializing processes as illustrated in FIG. 10 are called up in Step S11.

In the initializing processes, a communication port of the communicating module 14 (see FIG. 2) is set in Step S41. In Step S42, work setting is performed in accordance with, for instance, a type of the mounted cassette 20. During this step, it is possible to set whether the platen roller 39 and the tape feeding roller 40 are to be disposed at the releasing position or not when the tape printing apparatus 1 is not in use for a specified time. It is judged in Step S43 whether a release time is set for a time until release is performed after performing, for instance, printing or pressing.

If a release time is set, the program proceeds to Step S44, and 1 is substituted to a time setting flag F1 for indicating that the rollers are to be disposed at the releasing position after elapse of the release time. In Step S45, the release time is stored in the memory 15. If no release time is set, the program proceeds to Step S46 whereupon 0 is substituted to the time setting flag F1.

In Step S47, it is judged whether it has been set to dispose the platen roller 39 and the tape feeding roller 40 to the pressing position upon receipt of an inquiry signal from the personal computer 2. The inquiry signals are regularly sent by the editor of the personal computer 2 for requesting, or inquiring about, the conditions of the tape printing apparatus 1, such as types or widths of mounted tapes. The tape printing apparatus 1 is arranged to send such pieces of information to the personal computer 2 upon receipt of the inquiry signals.

If operations of disposing the platen roller 39 and the tape feeding roller 40 at the pressing position are to be performed each time an inquiry signal is received, 1 is substituted to an inquiry pressing flag F2 in Step S48. If no operations of disposing the platen roller 39 and the tape feeding roller 40 at the pressing position are to be performed even when an inquiry signal is received, 0 is substituted to an inquiry pressing flag F2 in Step S49. In this respect, various settings may be changed upon starting up the editor of the personal computer 2.

In Step S50, a continuous printing flag F3 for indicating that a plurality of pages are to be continuously printed is initialized. In Step S51, the platen roller 39 and the tape feeding roller 40 are disposed at the releasing position by driving the roller driving motor 43.

As will be described later, the platen roller 39 and the tape feeding roller 40 are disposed at the releasing position when the power is OFF. However, since the platen roller 39 and the tape feeding roller 40 will remain pressed when supply of power is terminated in the pressing condition, it has been devised to promptly cancel the pressed condition in Step S51. In this manner, the platen roller 39 and the tape feeding roller 40 are released in correspondence with the start-up operations.

Upon completion of the initializing processes, the program returns to the main program of FIG. 9, and respective steps of Step S12 to Step S29 are repeatedly performed. In Step S12, it is judged whether the power has been switched OFF. If the switch has been switched OFF, the program proceeds to Step S31 for disposing the platen roller 39 and the tape feeding roller 40 at the releasing position. In Step S32, supply of power is terminated.

In this manner, the platen roller 39 and the tape feeding roller 40 can be set to the released condition when the tape printing apparatus 1 is not in use. It is accordingly possible to prevent deformation or sticking of the platen roller 39 through pressure between the same and the print head 13. In a condition in which the cassette 20 is mounted, it is also possible to prevent deformation through pressure between the tape feeding roller 40 and the tape driving roller 28. As a result, it is possible to prevent degradations in tape feeding accuracy and an inability to print. In this respect, the apparatus is arranged in that the platen roller 39 and the tape feeding roller 40 are released in correspondence with the detection of power OFF through Step S31.

In Step S13, an open/closed condition of the opening/closing cover 8 is determined through the detection of the cover detector 17. If the opening/closing cover 8 is opened, the program proceeds to Step S16 to dispose the platen roller 39 and the tape feeding roller 40 at the releasing position. It will thus be possible to eject the cassette 20. In this respect, the apparatus is arranged in that the platen roller 39 and the tape feeding roller 40 are disposed at the releasing position in correspondence with the opening of the opening/closing cover 8 through Steps S13 and S16.

If the opening/closing cover 8 is closed, the program proceeds to Step S14, and it is judged whether the time setting flag F1 is 1. If the time setting flag F1 is 0, the program proceeds to Step S17. If the time setting flag F1 is 1, the program proceeds to Step S15 for determining whether the set release time has elapsed since the previous timing of the release time has been reset.

If the release time has not elapsed, the program proceeds to Step S17. If the release time has elapsed, the platen roller 39 and the tape feeding roller 40 are disposed at the releasing position in Step S16. It is accordingly possible to prevent deformation of the rollers or sticking of the rollers to the print head 13 caused through pressing the platen roller 39 and the tape feeding roller 40 at the pressing position for a prolonged period. In this respect, the apparatus is arranged in that the platen roller 39 and the tape feeding roller 40 are released when no print data are received for a specified time through Steps S15 and S16.

In Step S17, data are received by the communicating module 14. At this time, the print data are stored on the print buffer. The print data are sent from the personal computer 2 as, for instance, dot pattern data including dot data corresponding to a single line for a plurality of lines. In Step S18, it is determined whether a continuous printing command for performing printing of a plurality of pages in a continuous manner has been received from the personal computer 2. When printing of a plurality of pages is to be performed continuously, there are various patterns, for instance, in which printing of a plurality of pages is to be performed on the basis of different print data, in which printing of a plurality of pages is to be performed on the basis of the same print data, or in which a plurality of continuous numbers are printed in a continuous manner.

If the continuous printing command is received, the program proceeds to Step S19 and 1 is substituted to the continuous printing flag F3. In Step S20, it is determined whether a single page printing command for performing printing of a single page has been received. If a single page printing command has been received, the program proceeds to Step S21 and 0 is substituted to the continuous printing flag F3.

Figure 11:
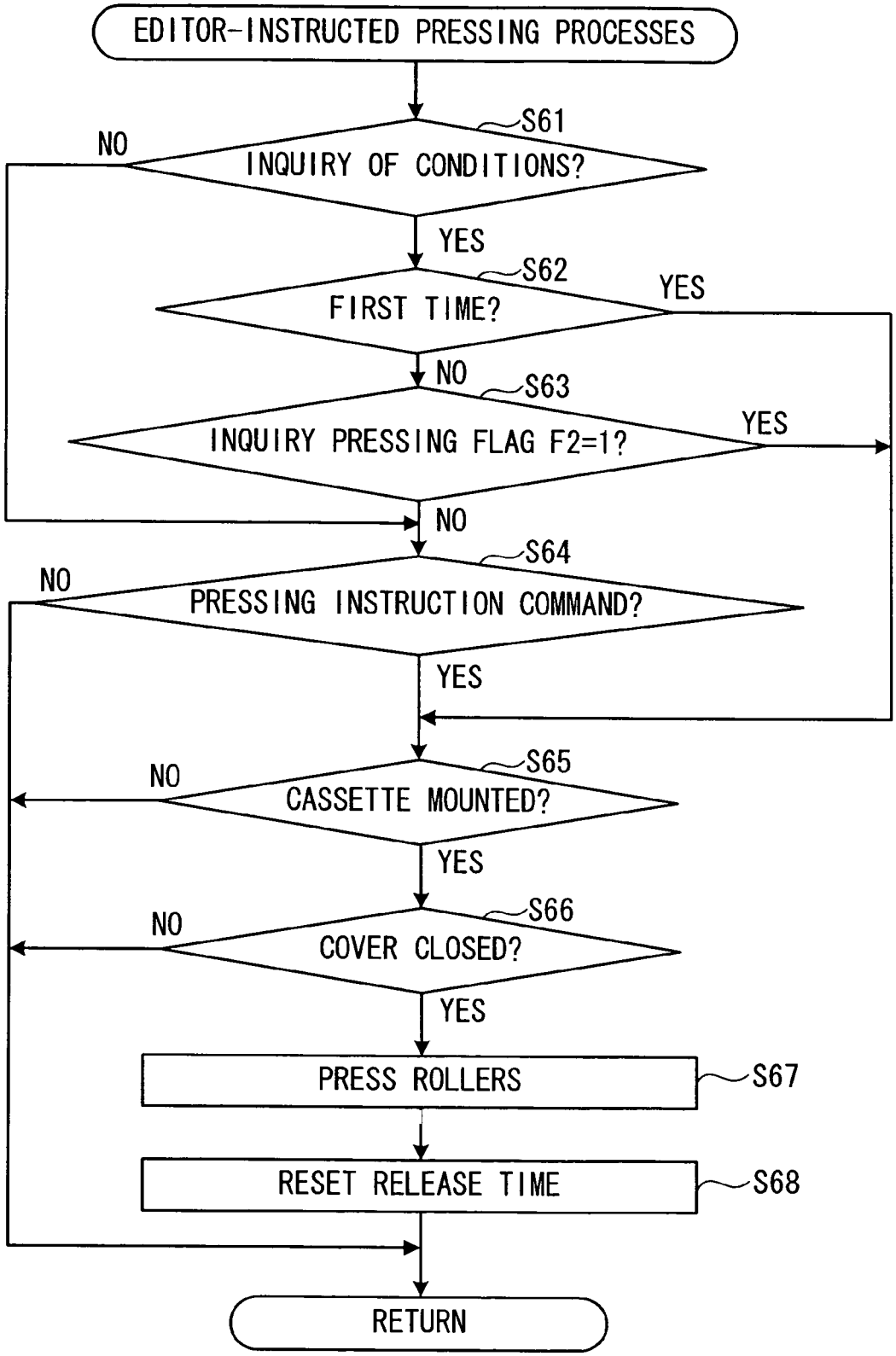
FIG. 11 is a flowchart illustrating editor-instructed pressing processes of the tape printing apparatus according to an exemplary embodiment of the invention.

In Step S22, editor-instructed pressing processes as illustrated in FIG. 11 are called up. In the editor-instructed pressing processes, it is determined in Step S61 whether an inquiry signal for requesting a condition of the tape printing apparatus has been received. If no inquiry signal has been received, the program proceeds to Step S64. If an inquiry signal has been received, it is determined in Step S62 whether this is the first time the signal has been received.

When the editor installed in the personal computer 2 is started, inquiry signals are regularly sent, and by receiving an inquiry signal for the first time, it is possible to detect that the editor has been started. If it is the first time receiving an inquiry signal, it is determined that the editor has been started, and the program proceeds to Step S65 for disposing the platen roller 39 and the tape feeding roller 40 at the pressing position.

If it is the second, or later, time to receive an inquiry signal, it is determined in Step S63 whether the inquiry pressing flag F2 is 1. If the inquiry pressing flag F2 is 1, the program proceeds to Step S65 for disposing the platen roller 39 and the tape feeding roller 40 at the pressing position. If the inquiry pressing flag F2 is 0, the program proceeds to Step S64.

In Step S64, it is determined whether a pressing instructing command for instructing pressing upon operation of a command button, or similar operation, that is provided at the editor has been received. If no pressing instructing command has been received, the program returns to the main program. If a pressing instructing command has been received, the program proceeds to Step S65 for disposing the platen roller 39 and the tape feeding roller 40 at the pressing position.

In Step S65, it is determined whether a cassette 20 is being mounted by the detection of the cassette detector 16. If no cassette 20 is mounted, the program returns to the main program. In Step S66, it is determined whether the opening/closing cover 8 is closed by the detection of the cover detector 17. If the opening/closing cover 8 is open, the program returns to the main program.

In Step S67, the platen roller 39 and the tape feeding roller 40 are disposed at the pressing position. With this arrangement, the platen roller 39 and the tape feeding roller 40 are disposed at the pressing position prior to receipt of print data so that printing can be started promptly.

In Step S68, the release time is reset, and the program returns to the main program. Tracking of the elapsed time after pressing is thus started, and upon elapse of the set release time, the platen roller 39 and the tape feeding roller 40 are disposed at the releasing position through the above-described steps S14 to S16.

It is determined in Step S23 of the main program whether print data have been received and whether the continuous printing flag F3 is 1. If no print data have been received and the continuous printing flag F3 is 0, the program returns to Step S12 for repeatedly performing steps S12 to S23. If print data are received, the program proceeds to Step S24. If the continuous printing flag F3 is 1, it may be that printing is performed without repeatedly receiving print data so that the program similarly proceeds to Step S24.

Figure 12:
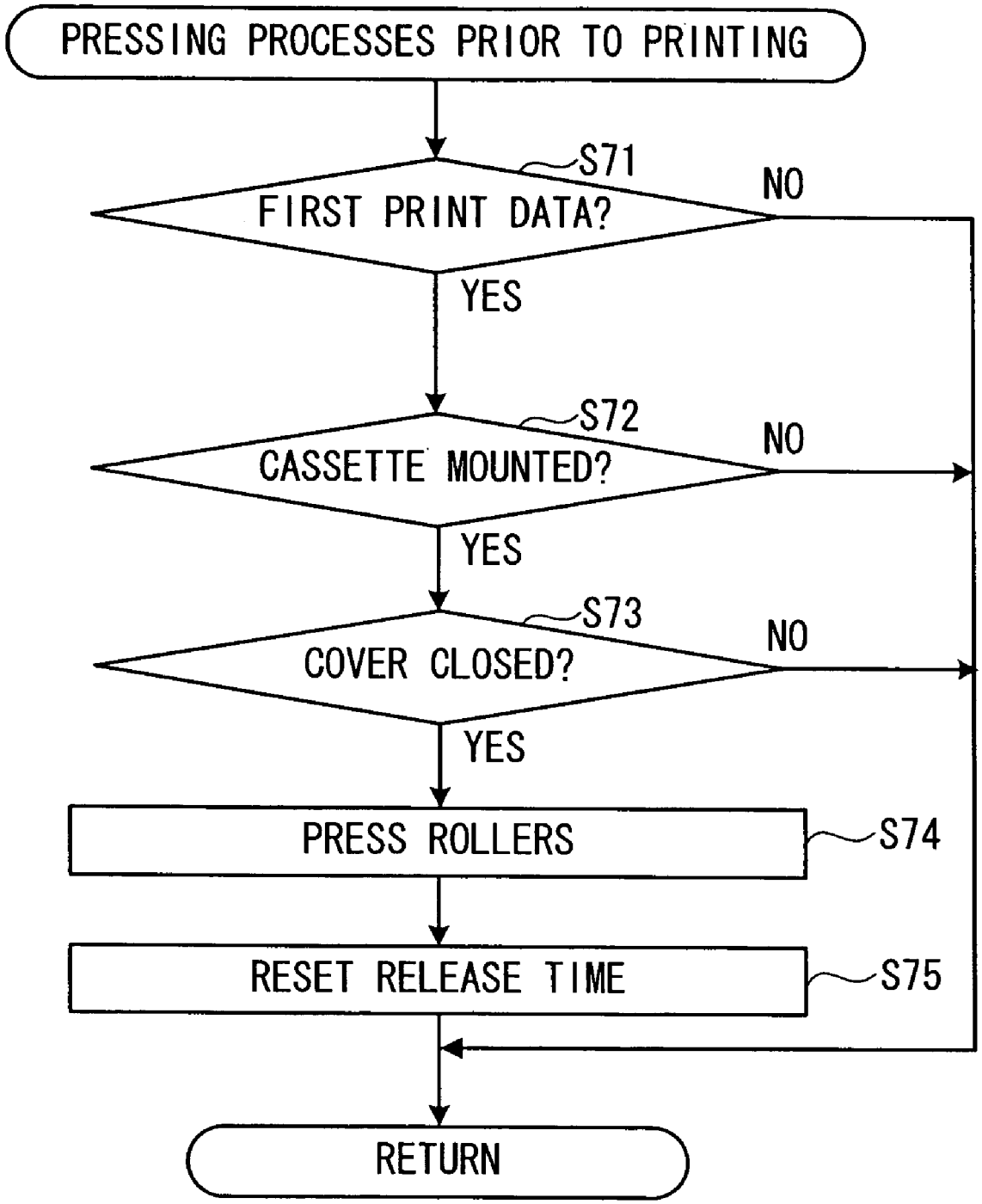
FIG. 12 is a flowchart illustrating pressing processes prior to printing of the tape printing apparatus according to an exemplary embodiment of the invention.

In Step S24, pressing processes prior to printing as illustrated in FIG. 12 are called up. It is determined in the pressing processes prior to printing whether the first print data have been received in Step S71. If the received data are not the first print data, the platen roller 39 and the tape feeding roller 40 are already in a pressed condition so that the program returns to the main program. If the received data are the first printing data, the program proceeds to Step S72.

In Step S72, it is determined whether the cassette 20 is being mounted through detection of the cassette detector 16. If no cassette 20 is being mounted, the program returns to the main program.

In Step S73, it is determined whether the opening/closing cover 8 is closed through detection of the cover detector 17. If the opening/closing cover 8 is open, the program returns to the main program.

In Step S74, the platen roller 39 and the tape feeding roller 40 are disposed at the pressing position. The platen roller 39 and the tape feeding roller 40, which have not been disposed at the pressing position due to an open opening/closing cover 8, or similar reasons, during the above-described editor-instructed pressing processes, are thus disposed at the pressing position prior to start of printing so that printing can be promptly started. In this respect, the apparatus is arranged in that the platen roller 39 and the tape feeding roller 40 are pressed in correspondence with received print data through Steps S71 and S74.

In Step S75, the release time is reset, and the program returns to the main program. In this manner, tracking of the elapsed time after pressing is started, and upon elapse of the set release time, the platen roller 39 and the tape feeding roller 40 are disposed at the releasing position through the above-described Steps S14 to S16.

Figure 13:
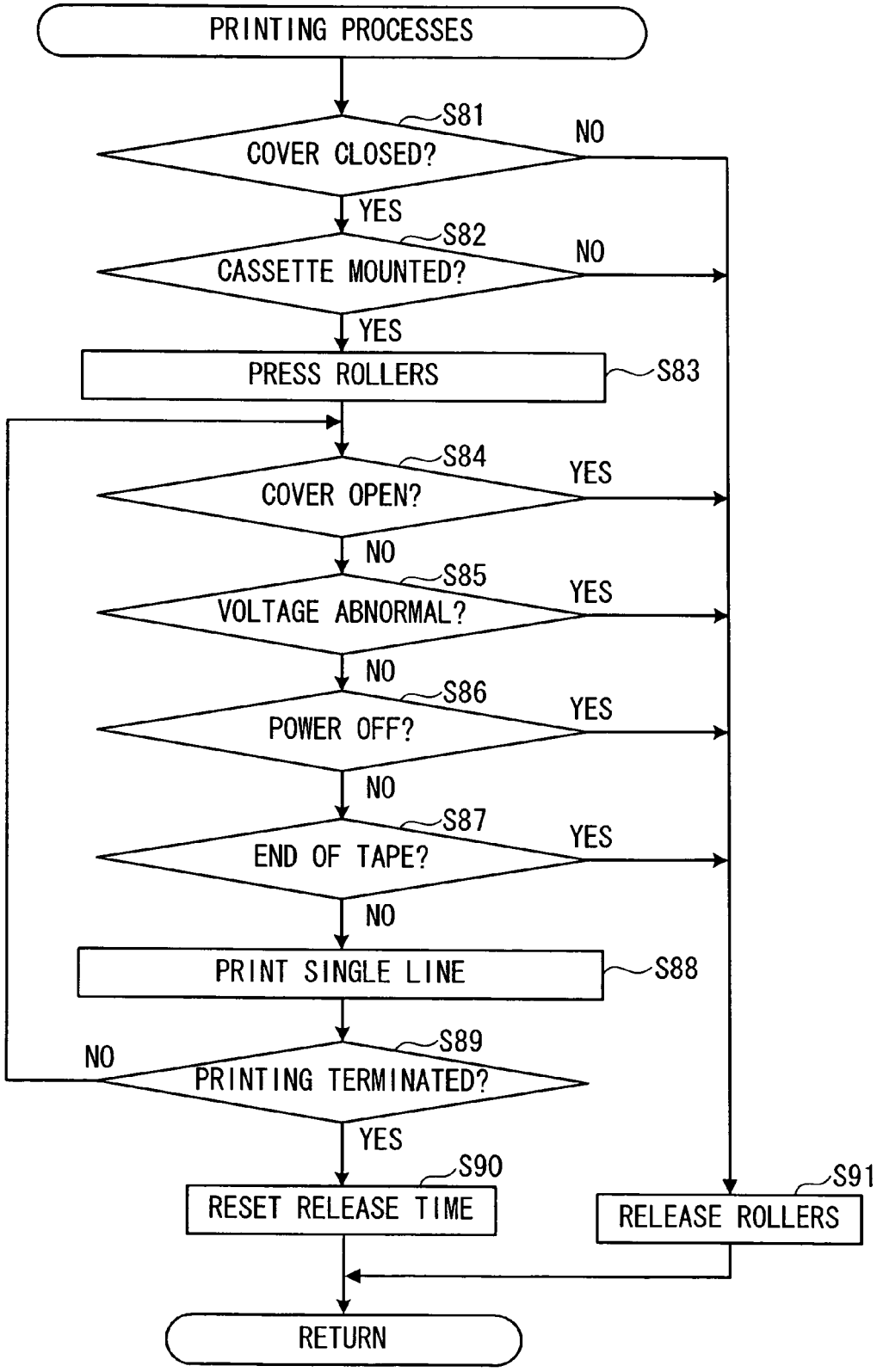
FIG. 13 is a flowchart illustrating printing processes of the tape printing apparatus according to an exemplary embodiment of the invention.

In Step S25 of the main program, it is determined whether a printing command has been received. If a printing command has been received, the program proceeds to Step S26, and the printing processes as illustrated in FIG. 13 are called up. In Step S81 of the printing processes, it is determined whether the cassette 20 is being mounted through detection of the cassette detector 16. If no cassette 20 is being mounted, the program proceeds to Step S91. In Step S82, it is determined whether the opening/closing cover 8 is closed or not through detection of the cover detector 17. If the opening/closing cover 8 is open, the program proceeds to Step S91.

In Step S83, the platen roller 39 and the tape feeding roller 40 are disposed at the pressing position. The platen roller 39 and the tape feeding roller 40, which have not been disposed at the pressing position due to an open opening/closing cover 8, or similar reasons, during the above-described editor-instructed pressing processes and the pressing processes prior to printing may thus be disposed at the pressing position.

Steps S84 to S87 are arranged to detect errors during printing, and if an error is detected, the program proceeds to Step S91. In this manner, the apparatus is arranged in that printing is interrupted, and the platen roller 39 and the tape feeding roller 40 are released in correspondence with the detection of the error.

In Step S84, an error due to an open opening/closing cover 8 is detected. In Step S85, an error due to occurrence of voltage abnormality is detected. In Step S86, an error due to switch OFF operation is detected. In Step S87, an error due to termination upon using up the tape 21 is detected.

In Step S91, the platen roller 39 and the tape feeding roller 40 are disposed at the releasing position. In this manner, printing is interrupted at the time an error has occurred and the pressed condition of the platen roller 39 and the tape feeding roller 40 is released. If an error due to switching OFF operation is detected, the program returns to the main program to proceed to Steps S31 and S32 upon determination of Step S12, and the processes are finally terminated.

If no error is detected, data corresponding to a single line are read out from the above print buffer in Step S88 for performing printing of a single line by the print head 13. In Step S89, it is determined whether printing of a single page has been completed, and if it is judged NO, the program returns to Step S84 for sequentially performing printing by each single line.

Upon completion of a printing of a single page, the program proceeds to Step S90 through determination of Step S89 for resetting the release time. In this manner, tracking of the elapsed time after printing is started, and upon elapse of the set release time, the platen roller 39 and the tape feeding roller 40 are disposed at the releasing position through the above-described Steps S14 to S16.

In Step S27 of the main program, it is determined whether the time setting flag F1 is 1. If the time setting flag F1 is 1, the program returns to Step S12. If the time setting flag F1 is 0, the program proceeds to Step S28 because the platen roller 39 and the tape feeding roller 40 are disposed at the releasing position each time printing is completed.

In Step S28, it is determined whether the continuous printing flag F3 is 1. If the continuous printing flag F3 is 1, printing is performed continuously so that no release is performed, and the program returns to Step S12. If the continuous printing flag F3 is 0, no continuous printing is performed so that the platen roller 39 and the tape feeding roller 40 are disposed at the releasing position in Step S29. In this respect, the apparatus is arranged in that the platen roller 39 and the tape feeding roller 40 are released in correspondence with completion of printing through Step S89 and Steps S27 to S29.

If continuous printing is performed, the continuous printing flag F3 remains unchanged from 1 through determination of Steps S18 and S20. Printing of the following page is then performed in Step S26 through Steps S22 to S25. Also, in the case of performing continuous printing, it is possible to release the platen roller 39 and the tape feeding roller 40 after completion of printing of a single page. In this case, by preliminarily setting either one of a first mode, in which release is performed after completion of printing of each of the pages that are continuously printed, and a second mode, in which release is performed only after completion of printing of all pages during the initializing processes (see FIG. 10), it is possible to release upon discriminating between the first and second modes in Step S28.

According to the exemplary embodiment, the platen roller 39 and the tape feeding roller 40 can be moved between the pressing position and the releasing position through the roller driving portion comprised of the roller driving motor 43, the reduction gear train 35, the release gear 41, and the release rod 37. With this structure, the platen roller 39 and the tape feeding roller 40 can be disposed at the releasing position when the power is OFF or upon completion of printing to thereby prevent deformation of the rollers or sticking of the rollers to the print head 13. It is accordingly possible to prevent degradations in tape feeding accuracy and the inability to print.

In this respect, while tape feeding is being performed through the platen roller 39 and the tape feeding roller 40, it is also possible to achieve the same effects with a structure, for instance, in which tape feeding is performed by the tape feeding roller 40 while the platen roller 39 is arranged not to perform tape feeding.

Although the above exemplary embodiment has been explained on the basis of a case in which the tape printing apparatus 1 is network-connected, it is also possible to employ, for instance, a local connection.

According to the invention, it is possible to prevent roller deformation or roller sticking caused through pressing of the platen roller against the print head. It is also possible to prevent deformation through pressing between the tape feeding roller and the tape driving roller in a condition in which the cassette is being mounted. It is consequently possible to obtain a tape printing apparatus and a tape printing system in which degradation of tape feeding accuracy and inability of printing are prevented.

According to another aspect of the invention, the apparatus comprises a receiver that receives print data, and the controller controls the roller driving portion such that the rollers are disposed at the pressing position in correspondence with print data received by the receiver. With this structure, the rollers are disposed at the pressing position when print data are received. It is accordingly possible to further prevent deformation and the rollers from sticking to the print head by pressing the rollers only when performing printing.

According to still another aspect of the invention, the controller controls the roller driving portion such that the rollers are disposed at the releasing position when no print data are received for a specified time. With this structure, the rollers are disposed at the releasing position when a period during which no print data are received reaches a specified time. The rollers will accordingly not be pressed when no printing is performed, to prevent deformation of the rollers and to prevent the rollers from sticking to the print head.

In the printing apparatus, the controller controls the roller driving portion such that the rollers are disposed at the releasing position in correspondence with the termination of printing to the tape. With this structure, the rollers are disposed at the releasing position when printing is terminated. It is accordingly possible to further prevent deformation of the rollers and the rollers from sticking to the print head by pressing the rollers only when performing printing.

In the printing apparatus, the controller includes a first mode in which the roller driving portion is controlled such that the rollers are disposed at the releasing position in correspondence with termination of printing of each page of a plurality of successive pages, and a second mode in which the roller driving portion is controlled such that the rollers are disposed at the releasing position in correspondence with termination of printing of all pages.

According to this structure, when the first mode is designated, the rollers are disposed at the releasing position after each termination of printing of a single page. When the second mode is designated, the rollers are not moved after termination of printing of a single page, but rather, the rollers are disposed at the releasing position upon termination of printing of all pages. The first and second modes may be either designated through an input device that is connected to the tape printing apparatus or set by the tape printing apparatus.

Accordingly, it is possible to minimize the pressing time through the first mode while it is possible to rapidly perform continuous printing upon reducing the release time through the second mode.

The printing apparatus also comprises an opening/closing cover that opens/closes a cassette accommodating portion that accommodates the cassette therein, and a cover detector that detects an open condition of the opening/closing cover. The controller controls the roller driving portion such that the rollers are disposed at the releasing position in correspondence with the detection of an open condition of the opening/closing cover by the cover detector. According to this structure, the rollers are disposed at the releasing position when the opening/closing cover is opened. It is accordingly possible to easily perform insertion/ejection of the cassette.

In the printing apparatus, when it is detected that the power switch is OFF, the controller controls the roller driving portion such that the rollers are disposed at the releasing position in correspondence with detection that the power switch is OFF. According to this structure, the rollers are disposed at the releasing position when the power switch is switched to OFF and supply of power is terminated. It is accordingly possible to prevent deformation of the roller and to prevent the roller from sticking to the print head when the tape printing apparatus is not in use.

The printing apparatus further comprises an error detector that detects an error during printing, and the controller controls the roller driving portion such that printing is stopped and that the rollers are disposed at the releasing position in correspondence with detection of an error. With this structure, when an error, such as opening of the opening/closing cover during printing, a voltage abnormality, tape end or power switch OFF, is detected, printing is terminated to dispose the rollers at the releasing position. The rollers will accordingly not be pressed when printing is not performed so that it is possible to prevent deformation of the rollers and to prevent the rollers from sticking to the print head.

In the printing apparatus, when the power switch is switched ON, the controller controls the roller driving portion such that the rollers are disposed at the releasing position in correspondence with the start-up operation. According to this structure, when the power of the tape printing apparatus is switched ON, the rollers are disposed at the releasing position. It is accordingly possible to release the pressing condition through re-supply of power when supply of power has been terminated in a condition in which the rollers are disposed at the pressing position.

The tape printing system according to the invention comprises the tape printing apparatus of each of the above-described structures and an input device having an editor through which print data are input upon connection to the tape printing apparatus. According to this structure, the input device and the tape printing apparatus are either network-connected, or local-connected in which they are directly connected without passing via a network, and print data are edited through the editor whereupon the print data are sent from the input device to the tape printing apparatus.

In the tape printing system of the above structure, the controller disposes the rollers at the pressing position upon start-up of the editor. According to this structure, a specified signal is sent from the input device upon start-up of the editor and the tape printing apparatus disposes the rollers at the pressing position upon receipt of this signal. It is accordingly possible to rapidly start printing without the necessity of being on stand-to for the pressing when starting printing.

In the tape printing system of the above structure, the input device sends an inquiry signal for requesting a condition of the tape printing apparatus, and the controller disposes the rollers at the pressing position upon receipt of this inquiry signal. According to this structure, an inquiry signal for requesting, or inquiring about, for instance, a width of the mounted tape is sent from the input device. The tape printing apparatus disposes the rollers at the pressing position upon receipt of the inquiry signal. It is accordingly possible to rapidly start printing without the necessity of being on stand-to for the pressing when starting printing.

Although the various elements of the exemplary embodiments are shown in various combinations and configurations, which are exemplary, other combinations and configurations, including more, less or only a single element, are also within the spirit and scope of the invention.

What is claimed is:

1. A tape printing apparatus, comprising:

at least one roller movable between a pressing position, at which the at least one roller is pressed against a tape, and a releasing position;

a roller driving portion that moves the at least one roller between the pressing position and the releasing position; and a controller that controls the roller driving portion such that the at least one roller is disposed at the pressing position or the releasing position in correspondence with input signals, the input signals including print data, wherein the controller controls the roller driving portion such that the at least one roller is disposed at the pressing position or the releasing portion in correspondence with at least the print data, and wherein the controller includes a first mode in which the roller driving portion is controlled such that the at least one roller is disposed at the releasing position in correspondence with termination of printing of respective pages of a plurality of successive pages and a second mode in which the roller driving portion is controlled such that the at least one roller is disposed at the releasing position in correspondence with termination of printing of all pages.

2. The tape printing apparatus according to claim 1, wherein the at least one roller is pressed against a print head that performs printing at the pressing position.

3. The tape printing apparatus according to claim 1, further comprising a receiver that receives the print data, wherein the controller controls the roller driving portion such that the at least one roller is disposed at the pressing position in correspondence with the print data that have been received by the receiver.

4. The tape printing apparatus according to claim 1, wherein the controller controls the roller driving portion such that the at least one roller is disposed at the releasing position when no print data are received for a specified time.

5. The tape printing apparatus according to claim 1, further comprising:

an opening/closing cover that opens and closes a cassette accommodating portion of the tape printing apparatus that accommodates the cassette; and a cover detector that detects an open condition of the opening/closing cover, wherein the controller controls the roller driving portion such that the at least one roller is disposed at the releasing position in correspondence with detection of an open condition of the opening/closing cover by the cover detector.

6. The tape printing apparatus according to claim 1, wherein the controller controls the roller driving portion such that the at least one roller is disposed at the releasing position in correspondence with detection of power OFF when it is detected that the power is OFF.

7. The tape printing apparatus according to claim 1, further comprising an error detector that detects an error during printing, wherein the controller terminates printing while it controls the roller driving portion such that the at least one roller is disposed at the releasing position in correspondence with detection of the error.

8. The tape printing apparatus according to claim 1, wherein the controller controls the roller driving portion such that the at least one roller is disposed at the releasing position in correspondence with start-up operations of the tape printing apparatus when power is switched ON.

9. A tape printing system, comprising:

the tape printing apparatus according to claim 1; and an input device including an editor through which print data are input upon connection with the tape printing apparatus.

10. The tape printing system according to claim 9, wherein the controller disposes the at least one roller at the pressing position upon start-up of the editor.

11. The tape printing system according to claim 9, wherein the input device sends an inquiry signal that requests a condition of the tape printing apparatus and the controller disposes the at least one roller at the pressing position upon receipt of the inquiry signal.

12. A tape printing apparatus, comprising:

at least one roller movable between a pressing position, at which the at least one roller is pressed against a tape accommodated in a cassette, and a releasing position, at which the at least one roller is remote from the tape, and arranged to perform printing by performing tape feeding upon disposing the at least one roller at the pressing position;

a roller driving portion that moves the at least one roller between the pressing position and the releasing position;

a controller that controls the roller driving portion in correspondence with input signals; and a receiver that receives print data, wherein the controller controls the roller driving portion such that the at least one roller is disposed at the pressing position in correspondence with print data that have been received by the receiver, wherein the controller controls the roller driving portion such that the at least one roller is disposed at the releasing position when no print data are received for a specified time, wherein the controller controls the roller driving portion such that the at least one roller is disposed at the releasing position in correspondence with termination of printing to the tape, and wherein the controller includes a first mode in which the roller driving portion is controlled such that the at least one roller is disposed at the releasing position in correspondence with termination of Printing of respective pages of a plurality of successive pages and a second mode in which the roller driving portion is controlled such that the at least one roller is disposed at the releasing position in correspondence with termination of printing of all pages.

13. The tape printing apparatus according to claim 12, wherein the at least one roller is pressed against a print head that performs printing at the pressing position.

14. The tape printing apparatus according to claim 12, further comprising:

an opening/closing cover that opens and closes a cassette accommodating portion of the tape printing apparatus that accommodates the cassette; and a cover detector that detects an open condition of the opening/closing cover, wherein the controller controls the roller driving portion such that the at least one roller is disposed at the releasing position in correspondence with detection of an open condition of the opening/closing cover by the cover detector.

15. The tape printing apparatus according to claim 12, wherein the controller controls the roller driving portion such that the at least one roller is disposed at the releasing position in correspondence with detection of power OFF when it is detected that the power is OFF.

16. The tape printing apparatus according to claim 12, further comprising an error detector that detects an error during printing, wherein the controller terminates printing while it controls the roller driving portion such that the at least one roller is disposed at the releasing position in correspondence with detection of the error.

17. The tape printing apparatus according to claim 12, wherein the controller controls the roller driving portion such that the at least one roller is disposed at the releasing position in correspondence with start-up operations when power is switched ON.

18. A tape printing system, comprising:

the tape printing apparatus according to claim 12; and an input device including an editor through which print data are input upon connection with the tape printing apparatus.

19. The tape printing system according to claim 18, wherein the controller disposes the at least one roller at the pressing position upon start-up of the editor.

20. The tape printing system according to claim 18, wherein the input device sends an inquiry signal that requests a condition of the tape printing apparatus and the controller disposes the at least one roller at the pressing position upon receipt of the inquiry signal.

21. A tape printing apparatus, comprising:

at least one roller movable between a pressing position, at which the at least one roller is pressed against a tape accommodated in a cassette, and a releasing position, at which the at least one roller is remote from the tape, and arranged to perform printing by performing tape feeding upon disposing the at least one roller at the pressing position;

a roller driving portion that moves the at least one roller between the pressing position and the releasing position;

a controller that controls the roller driving portion in correspondence with input signals;

a receiver that receives print data;

an opening/closing cover that opens and closes a cassette accommodating portion of the tape printing apparatus that accommodates the cassette;

a cover detector that detects an open condition of the opening/closing cover, wherein the controller controls the roller driving portion such that the at least one roller is disposed at the releasing position in correspondence with detection of an open condition of the opening/closing cover by the cover detector, an error detector that detects an error during printing, wherein the controller terminates printing while it controls the roller driving portion such that the at least one roller is disposed at the releasing position in correspondence with detection of an error, and wherein the controller controls the roller driving portion such that the at least one roller is disposed at the pressing position in correspondence with print data that have been received by the receiver, the controller controls the roller driving portion such that the at least one roller is disposed at the releasing position when no print data are received for a specified time, the controller controls the roller driving portion such that the at least one roller is disposed at the releasing position in correspondence with termination of printing to the tape, the controller includes a first mode in which the roller driving portion is controlled such that the at least one roller is disposed at the releasing position in correspondence with termination of printing of respective pages of a plurality of successive pages and a second mode in which the roller driving portion is controlled such that the at least one roller is disposed at the releasing position in correspondence with termination of printing of all pages, the controller controls the roller driving portion such that the at least one roller is disposed at the releasing position in correspondence with detection of power OFF when it is detected that the power is OFF, and the controller controls the roller driving portion such that the at least one roller is disposed at the releasing position in correspondence with start-up operations when power is switched ON.

22. The tape printing apparatus according to claim 21, wherein the at least one roller is pressed against a print head that performs printing at the pressing position.

23. A tape printing system, comprising:

the tape printing apparatus according to claim 21; and an input device including an editor through which print data are input upon connection with the tape printing apparatus.

24. The tape printing system according to claim 23, wherein the controller disposes the at least one roller at the pressing position upon start-up of the editor.

25. The tape printing system according to claim 23, wherein the input device sends an inquiry signal that requests a condition of the tape printing apparatus and the controller disposes the at least one roller at the pressing position upon receipt of the inquiry signal.

26. A method of controlling a tape printing apparatus having at least one roller movable between a pressing position at which the at least one roller is pressed against a tape mounted in a cassette and a releasing position in which the at least one roller is remote from the tape and arranged to perform printing by performing tape feeding upon disposing the at least one roller at the pressing position, the method comprising:

moving the at least one roller between the pressing position and the releasing position in correspondence with input signals, the input signals including print data, and disposing the at least one roller at the releasing position in correspondence with termination of printing of respective pages of a plurality of successive pages in a first mode and disposing the at least one roller at the releasing position in correspondence with termination of printing of all pages in a second mode, wherein the moving the at least one roller between the pressing position and the releasing portion in correspondence with at least the print data.

27. The method according to claim 26, further comprising pressing the at least one roller against a print head that performs printing at the pressing position.

28. The method according to claim 26, further comprising:

receiving the print data in a receiver of the printing apparatus; and disposing the at least one roller at the pressing position in correspondence with the print data that have been received by the receiver.

29. The method according to claim 26, further comprising disposing the at least one roller at the releasing position when no print data are received for a specified time.

30. The method according to claim 26, further comprising:

detecting a condition of an opening/closing cover of the tape printing apparatus by a cover detector; and disposing the at least one roller at the releasing position in correspondence with detection of an open condition of the opening/closing cover by the cover detector.

31. The method according to claim 26, further comprising disposing the at least one roller at the releasing position in correspondence with detection of power OFF when it is detected that the power is OFF.

32. The method according to claim 26, further comprising:

detecting an error during printing;

terminating printing; and disposing the at least one roller at the releasing position in correspondence with detection of the error.

33. The method according to claim 26, further comprising disposing the at least one roller at the releasing position in correspondence with start-up operations when power is switched ON.

34. A method of controlling a tape printing system having the tape printing apparatus according to claim 26 and an input device including an editor through which print data are input upon connection with the tape printing apparatus, the method comprising:

disposing the at least one roller at the pressing position upon start-up of the editor.

35. The method according to claim 34, further comprising:

sending an inquiry signal from the input device that requests a condition of the tape printing apparatus; and disposing the rollers at the pressing position upon receipt of the inquiry signal.

* * * * *